US007886750B2

(12) United States Patent
Coral

(10) Patent No.: US 7,886,750 B2
(45) Date of Patent: Feb. 15, 2011

(54) HAIR CLIP PROVIDED WITH A PODIUM

(76) Inventor: Hilaire Coral, La combe Bouvent, Oyonnax (FR) F-01100

( * ) Notice: Subject to any disclaimer, the term of this patent is extended or adjusted under 35 U.S.C. 154(b) by 753 days.

(21) Appl. No.: 11/458,774

(22) Filed: Jul. 20, 2006

(65) Prior Publication Data

US 2007/0028940 A1 Feb. 8, 2007

Related U.S. Application Data

(60) Provisional application No. 60/595,743, filed on Aug. 2, 2005.

(51) Int. Cl.
*A45D 8/00* (2006.01)
*A45D 8/20* (2006.01)

(52) U.S. Cl. ..... 132/276; 132/277

(58) Field of Classification Search ..... 132/277, 132/276, 273, 275, 278, 279; 24/515
See application file for complete search history.

(56) References Cited

U.S. PATENT DOCUMENTS

| | | | | |
|---|---|---|---|---|
| 4,557,503 | A * | 12/1985 | Linn | 281/47 |
| 5,862,815 | A * | 1/1999 | Murphy et al. | 132/277 |
| 6,186,151 | B1 * | 2/2001 | Newlin | 132/273 |
| 2004/0149306 | A1 * | 8/2004 | Rogers | 132/277 |
| 2004/0226574 | A1 | 11/2004 | Winn | |
| 2006/0124149 | A1 * | 6/2006 | Salisbury et al. | 132/277 |

FOREIGN PATENT DOCUMENTS

| | | |
|---|---|---|
| DE | 296 00 643 | 3/1996 |
| EP | 1 046 354 | 10/2000 |
| GB | 2 385 267 | 8/2003 |
| WO | WO 2005/025371 | 3/2005 |

* cited by examiner

*Primary Examiner*—Robyn Doan
(74) *Attorney, Agent, or Firm*—Sturm & Fix LLP

(57) ABSTRACT

Hair clip comprising two shells (1, 3) provided with claws (5, 7) which are at the front of the clip and pivot relative to one another around two shell hinges (8-12) which extend in the same axial direction (A) at the rear of the clip, from a closure position in which the claws (5, 7) are brought together or even intersect, in order to grip the hair trapped by the claws, to an opening position in which the claws are spaced apart against the deformation of a resilient return means (13, 131, 132) which tends to return the shells (1, 3) to the closure position, and comprising a support plate (17) which is designed to receive for example a jewel and two lugs (19-22) which support the support plate (17) above the two shells (1, 3) in the closure position.

The two lugs (19-22) are engaged with the two shells (1, 3), to the front of the axial direction (A) in the closure position, in order to give rise to a movement of lifting of the support plate (17) relative to the axial direction (A), in translation towards the rear, when the two shells (1, 3) pivot from the closure position to the opening position.

8 Claims, 5 Drawing Sheets

HAIR CLIP PROVIDED WITH A PODIUM

CROSS REFERENCE TO RELATED APPLICATIONS

This application claims priority from U.S. Provisional Patent Application Ser. No. 60/595,743 filed Aug. 2, 2005, and is incorporated by reference herein in its entirety.

BACKGROUND OF THE INVENTION

1. Field of the Invention

The invention relates to a hair clip comprising more particularly two shells which are provided with claws at the front of the grip and which pivot relative to one another around two shell hinges which extend in the same axial direction to the rear of the clip. The two shells pivot from a closure position in which the claws are brought together or even intersect, in order to grip the hair trapped by the claws, to an opening position in which the claws are spaced apart in order to release the hair. A resilient return means is deformed, and tends to oppose the pivoting of the two shells in the opening position, and to return them to the closure position.

2. Description of the Related Art

A hair clip of this type is known in particular from document DE-A-29600643 or document WO2005/025371.

In the first document, the resilient return means is a spring which is fitted around a shaft which is supported by the two shell hinges, and acts on two levers which are integrated respectively in the two shells. A cover, comprising two lugs which are articulated to one another and are each connected to the lever of each shell by a hinge, is provided in order to conceal the spring, in particular in the closure position. The cover which is secured to the lever has a large dimension, in particular in the opening position of the hair clip.

In the second document, the spring has been replaced by a link made of elastomer material, which is stretched between the two shells in order to be concealed by the latter, in particular in the closure position.

Document US 2004/0226574 discloses a hair clip as previously described, which in addition comprises a support plate which is designed to receive a jewel for example. It is supported above the two shells by the two levers of the clip with which it is engaged to the rear of the axial direction of pivoting of the two shells. When the levers are brought close to one another in order to make the two shells pivot from the closure position to the opening position, the support plate pivots relative to the levers.

The articulation of the support plate on the levers themselves appears to impede the handling of these levers for the purpose of opening the hair clip. In addition, the pivoting of the support plate relative to the levers increases the size of the clip from the front to the rear in the opening position, which also does not seem to contribute to easy handling of the clip by a user.

SUMMARY OF THE INVENTION

The object of the invention is to modify a hair clip of the type previously described, in order to reduce the size required by the presence of the support plate, in particular in the opening position. The purpose of the invention is thus easier handling of the hair clip.

For this purpose, the subject of the invention is a hair clip of the type previously described, characterised in that the two lugs are engaged with the two shells, at the front of the axial direction in the closure position, in order to give rise to a movement of lifting of the support plate relative to the axial direction, in translation towards the rear, when the two shells pivot from the closure position to the opening position.

By means of this arrangement, the lifting of the support plate relative to the axial direction of pivoting, in translation towards the rear, can be regulated according to the length of the lugs which support it and the position of the engagement of the latter with the two lugs, to the front of the axial direction.

The support plate and the two support lugs thus form a podium, which has a reduced size for as long as it is lowered relative to the axial direction, the clip being in the closure position, or when it is lifted relative to this axial direction, the clip being in the opening position. This means that the support plate of the podium can receive a jewel of any size.

According to a preferred embodiment, the lugs are engaged with the inner walls of the two shells and extend between the two shell hinges and between two rear edges of the shells which clamp around the lugs as the support plate is lifted relative to the axial direction of pivoting, when the two shells pivot from the closure position to the opening position. The securing onto the inner walls of the two shells contributes towards protecting the podium, which is less exposed.

In this preferred embodiment, the podium has two lugs which are disposed head to tail, and are bent such as to intersect when the two shells are in the closure position, and such as to coincide between the two rear edges of the clamped shells when the two shells are in the opening position.

This arrangement makes it possible to control the lifting of the podium in a first stage with a low level of lifting, whilst the two lugs intersect, and in a second stage with a high level of lifting, when the bent parts of the two lugs coincide with one another. This arrangement also decreases the size of the podium and reduces the spacing between the two rear edges of the two shells which is necessary for the two lugs to extend.

Other advantages of the invention will become apparent from reading the description of two embodiments illustrated by the drawings.

DETAILED DESCRIPTION OF THE PREFERRED EMBODIMENT

With reference to FIGS. 1 to 8, a hair clip comprises two shells 1, 3 which are provided with claws 5, 7 at the front of the clip, and pivot relative to one another around two shell hinges which extend according to the same axial direction A at the rear of the clip.

Figure 6:
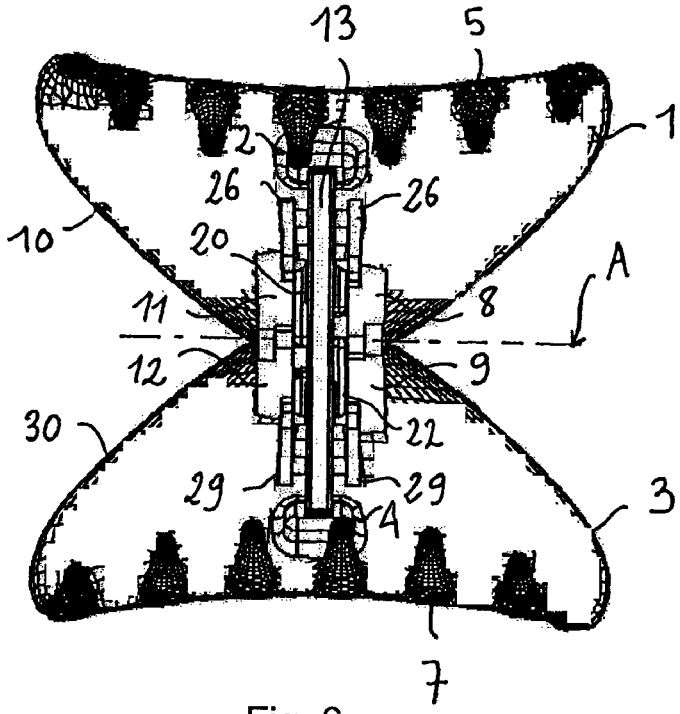
FIG. 6 shows in front view the clip illustrated in FIG. 4.

In the example illustrated in FIG. 6, the two shell hinges each comprise two components, one of which 8, 11 is secured to one 1 of the two shells, and the other of which 9, 12 is secured to the other 3 of the two shells. As can also be seen clearly in FIG. 8, one 8, 11 of the components of each hinge which is secured to each shell is provided with a hinge pin to be inserted in a bore in the other component 9, 12 which is secured to the other shell.

Figure 7:
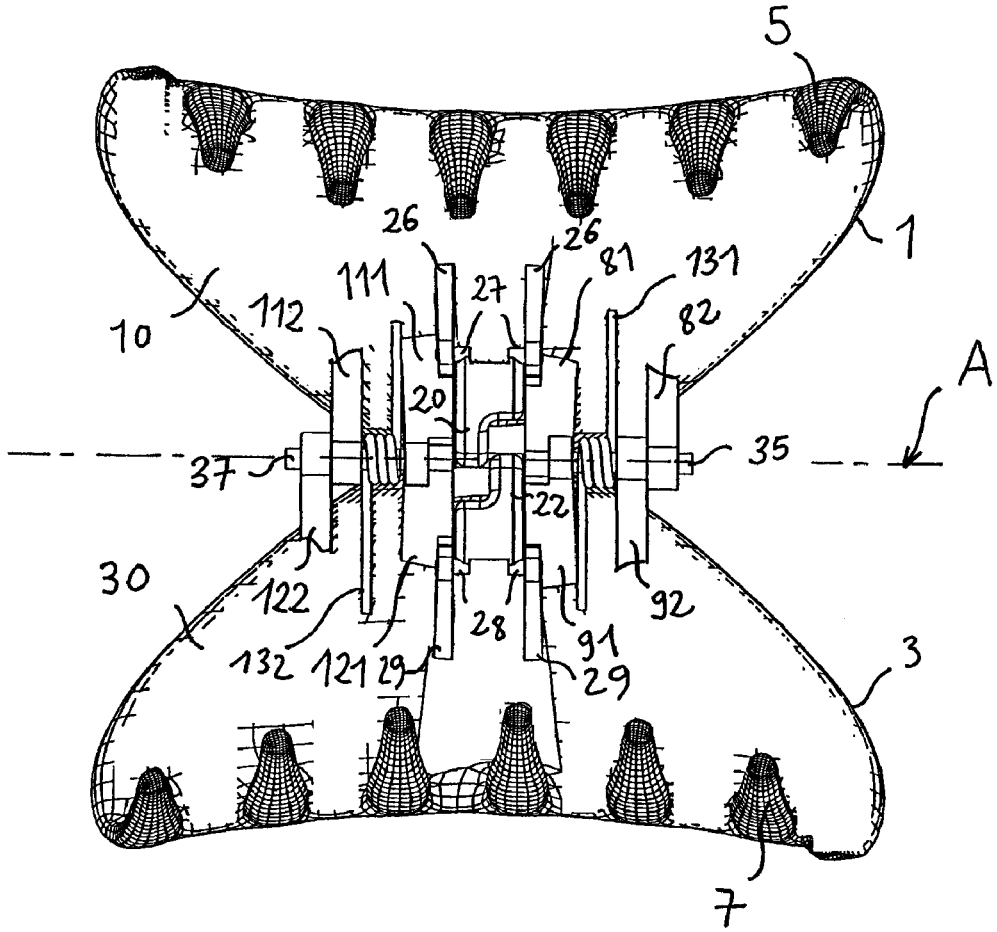
FIG. 7 shows in front view a variant of the second embodiment in which the resilient return means is a pair of springs.
Figure 8:
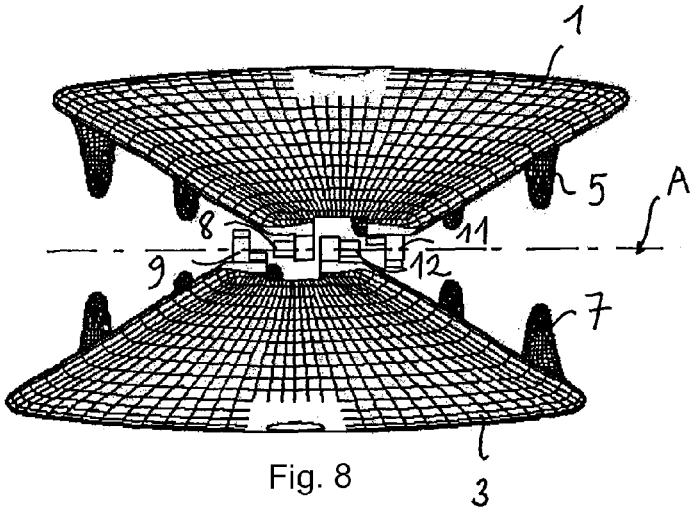
FIG. 8 shows in front view the shell hinges of a clip according to the first or second embodiment.

In the example illustrated in FIG. 7, the shell hinges are each doubled into two pairs. A first pair of shell hinges comprises two components 81, 82 which are secured to one 1 of the two shells and two components 91, 92 which are secured to the other shell 3. Similarly, a second pair of shell hinges comprises two components 111, 112 which are secured to one 1 of the two shells and two components 121 122 which are secured to the other shell 3. The two pairs of shell hinges allow the two shells to pivot relative to one another around the same axial direction A, each pair supporting respectively a shaft 35, 37 which passes via the components respectively 81, 82, 91, 92 and 111, 112, 121, 122 of each pair of shell hinges.

It should be noted that in both the cases previously described, the two shell hinges 8, 9, 11, 12 or the two pairs of shell hinges 81, 82, 91, 92 and 111, 112, 121, 122 are spaced from one another in the axial direction A in order to permit the passage of the lugs of the podium according to the invention, as will be described hereinafter.

The two shell hinges or the two pairs of shell hinges allow the two shells 1, 3 to go from a closure position in which the claws 5, 7 are brought together or even intersect, in order to grip the hair which is trapped by the claws, and by an inner wall 10, 30 of each shell, to an opening position in which the claws are spaced from one another. In the example in FIGS. 4 and 5, the two shells abut by means of two rear edges the shells 23, 25 which are opposite the claws 5, 7. The claws 5, 7 way be integral with the shells 1, 3 or separate elements fixed on the shells. In that latter case, the pivoting shells 1, 3 and the podium 15 build an intermediate structure to be assembled with the claws 5, 7.

The pivoting to the opening position takes place against the deformation of a resilient return means which tends to return the two shells 1, 3 to the closure position.

In the example in FIGS. 1 to 5, the resilient return means is a link 13 made of elastomer material which is stretched between the two shells 1, 3. The link 13 is for example flat or cylindrical, and is made of rubber or polyurethane. Preferably, this material has a Shore A hardness of between 60 and 90 units.

Figure 3:
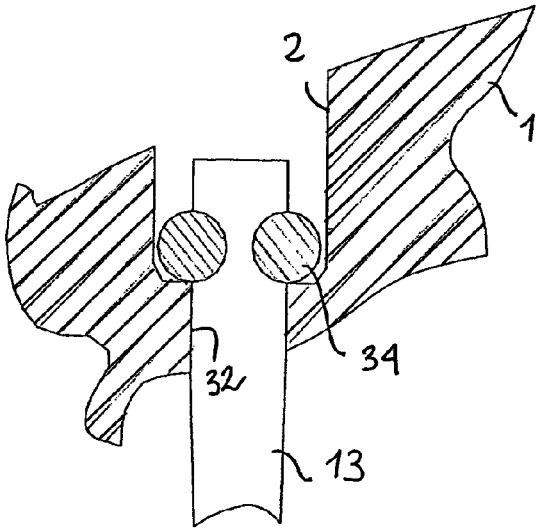
FIG. 3 shows in detail a method for securing the link to the shells of the clip illustrated in FIGS. 1 and 2.

The link 13 is stretched between the shells 1, 3 via passages 32 in order to be received in securing notches 2 and 4. It is secured for example by means of a U-shaped part 34 which is engaged with each of the two ends of the link, in order to retain the latter in each of the corresponding securing notches. This method for securing the link is illustrated by FIG. 3, which shows in detail the arrangement of the U-shaped part engaged with an end of the link. Securing parts other than U-shaped one in the shape of a "U" are also suitable for securing the link 13 onto each of the shells 1, 3, and in particular a metal gripping part or a clamp.

In the example in FIGS. 1 to 5, the securing notches 2, 4 are provided close enough to the edges of the shells 23, 25 opposite the claws 5, 7 to allow the link 13 to pass through the axial direction A of pivoting between the two shell hinges 8, 9, 11, 12 or between the two pairs of shell hinges 81, 82, 91, 92 and 111, 112, 121, 122, when the shells pivot from the closure position to the opening position. By means of this arrangement, the link 13 stabilises the hair clip in the opening position in order to allow a user to place it better on her hair. Once the clip has been put into place, the user can easily close it into the closure position.

In the example in FIG. 7, the resilient return means comprise two springs respectively 131, 132, which are fitted around the two shafts respectively 35, 37, each of which is supported by a pair of shell hinges previously described. Each spring 131, 132 is supported by end lugs on each of the two shells 1, 3.

According to the invention, the hair clip comprises a podium 15 comprising a support plate 17 which is designed to receive for example a jewel and two lugs 19, 21 or 20, 22 which support the support plate 17 and are engaged with the shells 1, 3 to the front of the axial direction of pivoting A.

In the examples illustrated in FIGS. 1 to 7, the support lugs are engaged with the inner walls 10, 30 of the two shells 1, 3 and are provided with hinge pins 27, 28 which are engaged in two podium hinge components 26, 29 secured to the inner walls 10, 30 of the two shells. The hinge pins 27, 28 are for example engaged in the podium hinge components 26, 29 by means of simple resilient gripping of the hinge pin in the corresponding hinge component.

The two lugs 19, 21 or 20, 22 extend between the two shell hinges 8, 9, 11, 12 or between the two hinges 81, 91 and 111, 121 which are closest to one another in the axial direction A, whilst one of them 81, 91 belongs to the first pair of shell hinges and the other 111, 121 belongs to the second pair of shell hinges. It should be noted that the lugs 19, 21 or 20, 22 which are thus secured to the inner wall of the shells 1, 3 and extend between the two shell hinges advantageously make it possible to lock in translation, in the axial direction A of pivoting, the components of the shell hinges which are engaged in one another. By this means, it is not necessary to provide a means for retention of the hinge pins or of the shafts 35, 37 in the corresponding bores. However, it may be advantageous to end-roll the hinge pins or shafts 35, 37. The two lugs 19, 21 or 20, 22 also extend between two rear edges 23, 25 of the shells opposite the claws 5, 7 and are clamped around the two lugs as the support plate 17 is lifted relative to the axial direction of pivoting A when the two shells pivot from the closure position to the opening position.

Figure 1:
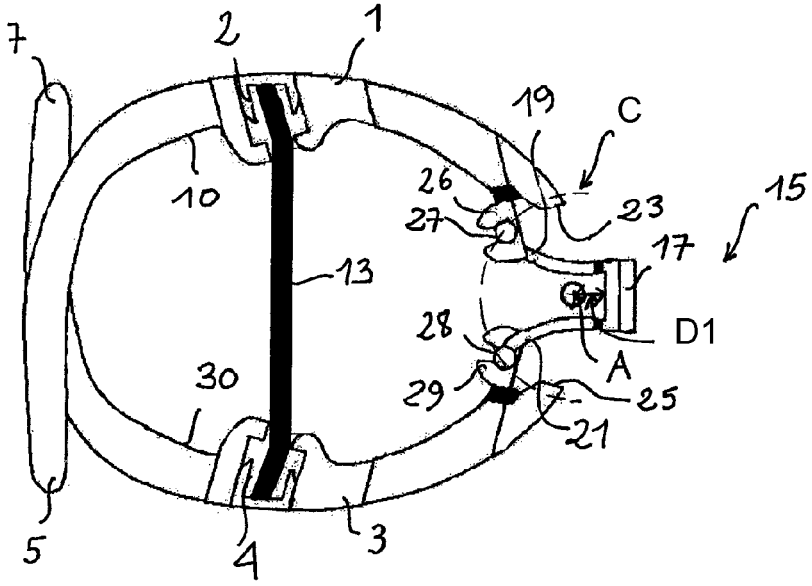
FIG. 1 shows in cross-section a clip in the closed position according to a first embodiment of the invention.
Figure 2:
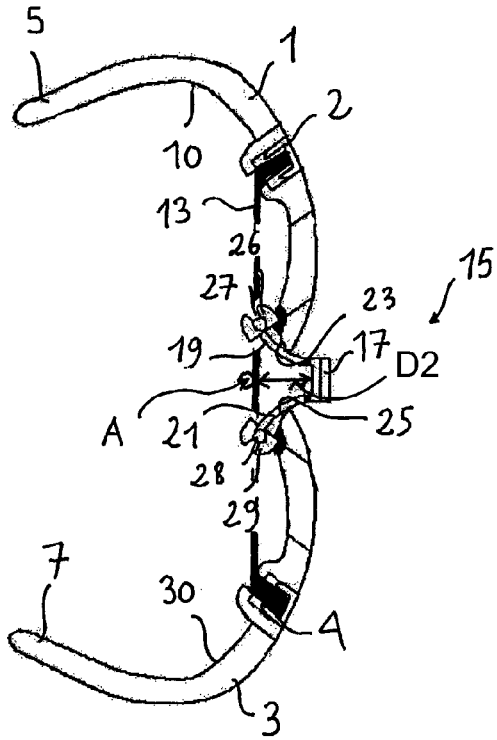
FIG. 2 shows in cross-section the clip in FIG. 1 in the open position.

The lifting of the podium relative to the axial direction of pivoting A is derived from the fact that during the pivoting, the two podium hinge components 26, 29 which are secured to the inner walls of the two shells 1, 3 entrain the two hinge pins 27, 28 in circular displacement C which is centred on the axial direction A, but in two opposite directions of rotation corresponding to the two opposite directions of pivoting of the two shells 1, 3. However the two circular displacements in opposite directions of rotation combine in a displacement in translation in the same direction for both of the hinge pins 27, 28. This displacement in translation of the two hinge pins 27, 28 of the lugs 19, 21 or 20, 22 of the podium gives rise to the lifting of the support plate 17 relative to the axial direction A. As illustrated by FIGS. 1 and 2, the lifting is derived from an increase in the distance which separates the axial direction A of the support plate, going from a distance D1 in the closure position, to a distance D2, which is greater than D1, in the opening position. The direction of this displacement in translation is imposed by the fact that the lugs 19,21 or 20, 22 extend towards the rear in order to support the support plate above the two shells, for example by extending between the two rear edges 23, 25 of the shells which are clamped around these lugs 19, 21 or 20, 22 when the shells 1, 3 pivot into the opening position.

Regulation of the length 19, 21 or 20, 22 of the podium provides control of the lifting of the podium relative to the axial direction, just above the two shells 1 and 3 which are open relative to one another in the opening position. This means that a jewel of any size can be secured to the support plate 17, without impeding the pivoting of the shells into the opening position.

According to a first embodiment of the invention, which is illustrated more particularly by FIGS. 1 and 2, the two lugs 19, 21 of the podium 15 each extend on one side of the support plate 17 without intersecting.

Figure 4:
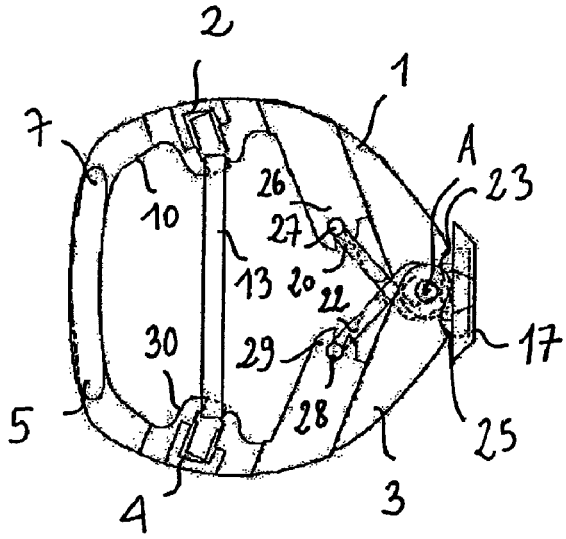
FIG. 4 shows in cross-section a clip in the closed position according to a second embodiment of the invention.
Figure 5:
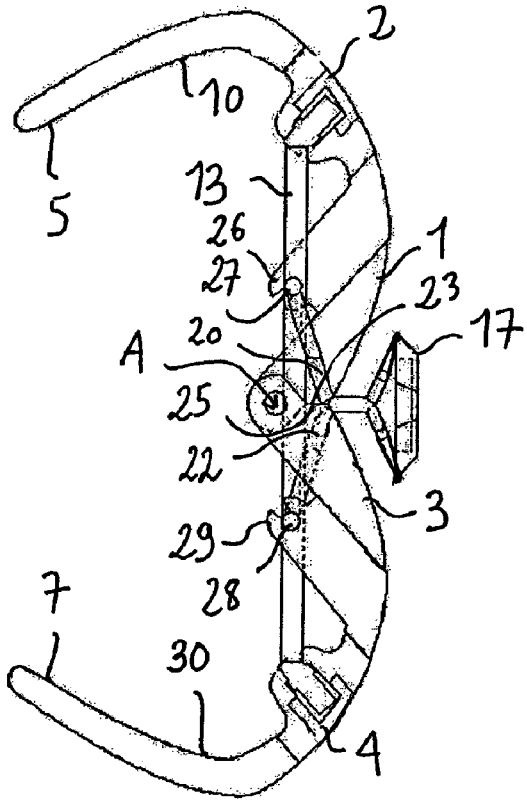
FIG. 5 shows in cross-section the clip in FIG. 4 in the open position.
Figure 9:
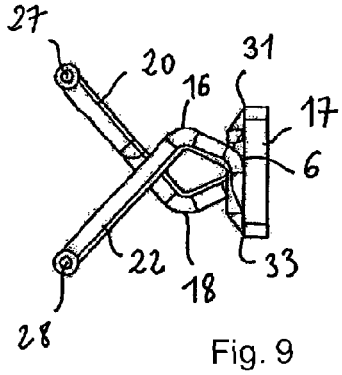
FIG. 9 shows the podium used in the hair clip according to the second embodiment, in a lowered position corresponding to a closure position of the clip.
Figure 10:
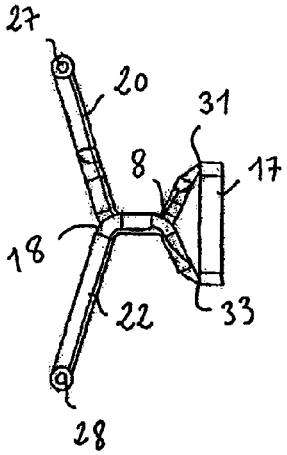
FIG. 10 shows the podium in FIG. 9 in a lifted position corresponding to an opening position of the clip.

According to a second embodiment, which is illustrated more particularly by FIGS. 4 and 5, and details of which are given in FIGS. 9 and 10, the two lugs 20, 22 of the podium 15 are fitted head to tail, and are bent at first bends 16, 18 and second bends 6, 8 in order to intersect when the clip is in the closure position, FIG. 9, and to coincide between the rear edges of shells 23, 25 when the clip is in the opening position, FIG. 10. For each of the two lugs 20, 22, the coincidence concerns the portion which is contained between the first bend 6, 8 and the second bend 16, 18. As previously stated, the lifting of the podium 15 is thus controlled in a first stage with a low level of lifting, during which the two lugs 20, 22 still intersect, and in a second stage it is controlled with a high level of lifting, when the portions contained between the first and second bends coincide with one another. This arrangement reduces the size of the podium 15 and reduces the spacing between the edges 23, 25 of the two shells 1, 3 which is necessary for the two lugs 20, 22 to extend.

Figure 11:
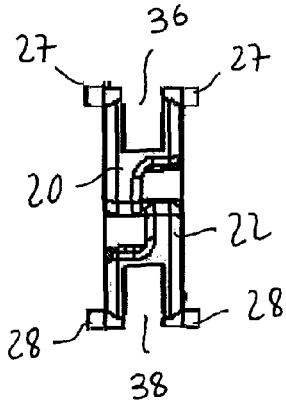
FIG. 11 shows in front view the lugs of the podium illustrated by FIGS. 9 and 10, indented in the region of the hinge pins.
Figure 12:
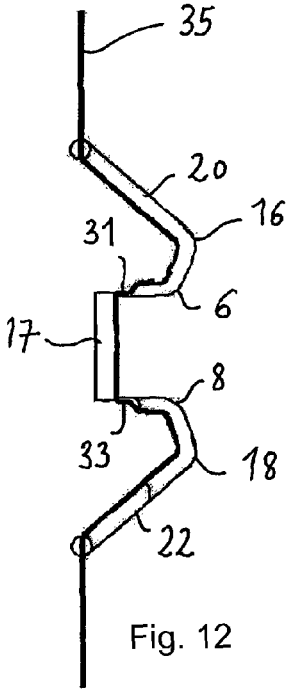
FIG. 12 shows schematically a joint face for production by injection moulding of the podium illustrated by the preceding FIGS. 9, 10 and 11.
Figure 13:
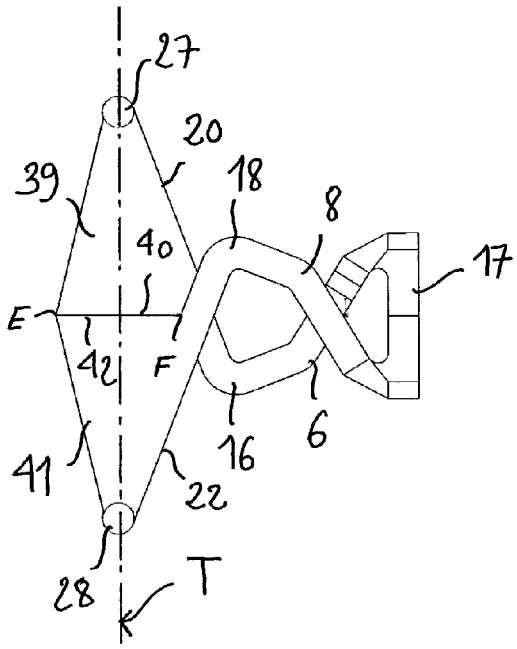
FIG. 13 shows a third embodiment of the podium in which the two lugs are provided with stops.
Figure 14:
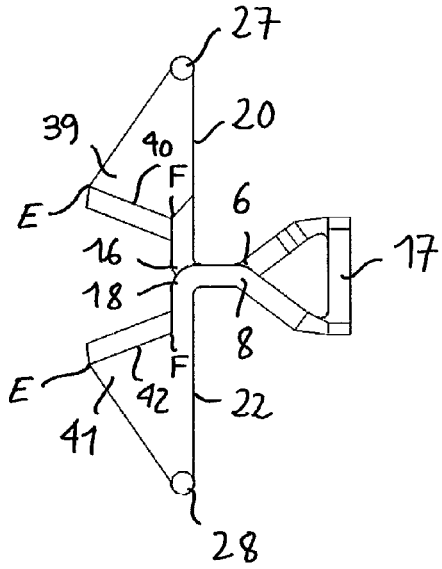
FIG. 14 shows the podium in FIG. 13, the stops being spaced from one another.

With reference to FIG. 11, the lugs 20, 22 of the podium 15 are preferably indented 36, 38 in the region of the hinge pins 27, 28 in order to receive the link 13 when the latter has passed through the axial direction of pivoting A into the opening position of the two shells.

According to a third embodiment of the invention, FIGS. 13 to 16, the lugs of the podium are provided with stops 39, 41 which abut one another when the two lugs intersect in the closure position of the shells. By means of this arrangement, the lugs of the podium limit the course of pivoting of the two shells into the closure position. As a result, when the two claws are designed to intersect in the closure position, they themselves no longer form a stop. In other words, the return of the two shells to the closure position no longer leads to impact of the two claws against one another, which would cause a snapping noise which a user of the hair clip might find annoying.

In the example illustrated in FIGS. 13 to 16, the stops 39, 41 extend between the hinge pins 27, 28 and the first bends 16, 18 of each lug.

Figure 16:
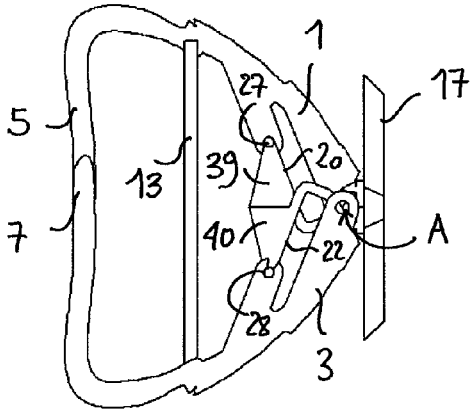
FIG. 16 shows a third embodiment of the invention provided with the podium shown by FIGS. 13 to 15, the clip being in the closure position.

Preferably, the stops 39,41 are so shaped that they abut one against the other on the opposite side of the support plate 17 with respect to the line T joining the two hinge pins 27, 28. This arrangement allows the stops 39,41 to better oppose the return force of the resilient return means 13 of the two shells 1, 3 into the closure position. FIG. 16, one prevents the two stops 39,41 to pivot one with respect to the other and the support plate 17 to be moved in translation towards the rear. In the illustrated example, the stops 39, 41 have a triangular shape the summit of which is at the place of the hinge pin 27, 28 and the basis, at the place of a contact edge 40, 42 of each stop 39, 41 that extend from a first end E, on the side opposite to the support plate 17 with respect the line T when the stops 39, 41 abut one against the other, FIG. 13 or 16, to a second end F, on the same side than the support plate 17 with respect to the line T.

Figure 15:
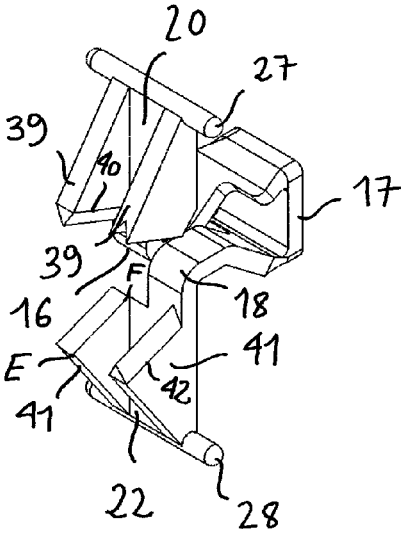
FIG. 15 shows in perspective the podium in FIGS. 13 and 14.

The podium 15 according to the first, second or third embodiment can be made for example of metal, the thickness of the lugs being designed to permit bending deformation when the fasteners 27, 28 describe arcs of a circle of the circular trajectory previously indicated. Preferably, the podium 15 is a part made of moulded injected plastics material with thinned parts of material 31, 33 at the junctions between the lugs 19, 21 and 20, 22 and the support plate 17. FIG. 15 shows schematically a joint face for production by moulding and injection of the podium illustrated by FIGS. 9, 10 and 11.

The invention claimed is:

1. Hair clip comprising two shells provided with claws which are at the front of the clip and pivot relative to one another around two shell hinges spaced from one another in a same axial direction of pivoting at the rear of the clip, from a closure position in which the claws are brought together or even intersect, in order to grip the hair trapped by the claws, to an opening position in which the claws are spaced apart against the deformation of a resilient return means which tends to return the shells to the closure position, comprising a support plate which is designed to receive a jewel and comprising two lugs which support the support plate above the two shells in the closure position, wherein the two lugs are engaged with the two shells in the front of the axial direction of pivoting in the closure position and extend between the two spaced shell hinges and between two rear edges of the shells, so that the support plate is lifted relative to the axial direction in translation towards the rear, from a first distance of the support plate with respect to the axial direction of pivoting to a second distance, greater than the first distance, of the support plate with respect to the axial direction of pivoting, when the two shells pivot from the closure position to the opening position, wherein the two lugs are made foldable at junctions with the support plate to respectively fold with respect to the support plate as said support plate is lifted, wherein the two lugs are disposed head to tail and are each provided with first and second bends so that a portion extending between the two bends of one of the lugs coincide with a portion extending between the two bends of the other lug between the two clamped shell edges when the shells are in the opening position, and wherein the support plate and the two lugs are made in a single piece of molded injected plastics material with thinned parts of material at the junctions between the lugs and the support plate.

2. Hair clip according to claim 1, wherein that the two lugs are engaged with inner walls of the two shells and extend between two rear edges of the shells which clamp around the lugs as the support plate is lifted relative to the axial direction of pivoting when the two shells pivot from the closure position to the opening position.

3. Hair clip according to claim 1, wherein the lugs are provided with hinge pins which are engaged in two podium hinge components which are secured relative to the shells.

4. Hair clip according to claim 1, wherein the two lugs are provided with stops which abut one against the other when the two lugs intersect in the closure position of the two shells.

5. Hair clip according to claim 4, wherein the stops extend between the hinge pins and the first bends of each lug.

6. Hair clip according to claim 4, wherein the stops are so shaped that they abut one against the other on the opposite side of the support plate with respect to a line joining the two hinge pins when two shells are in the closure position, thus preventing the stops to pivot, one with respect to the other and the support plate to be moved in translation towards the rear.

7. Hair clip according to claim 1, wherein the resilient return means comprises two springs which are fitted around two shafts each of which is supported by a pair of shell hinges.

8. Hair clip according to claim 1, wherein the resilient return means is a link made of elastomer material which is stretched between the two shells.

* * * * *